US006244073B1

(12) United States Patent
Kaping, Jr.

(10) Patent No.: US 6,244,073 B1
(45) Date of Patent: Jun. 12, 2001

(54) BODY JEWELRY CAP

(76) Inventor: Dennis John Kaping, Jr., 9983 Paseo Montril, San Diego, CA (US) 92129

( * ) Notice: Subject to any disclaimer, the term of this patent is extended or adjusted under 35 U.S.C. 154(b) by 0 days.

(21) Appl. No.: 09/245,276

(22) Filed: Feb. 5, 1999

(51) Int. Cl.[7] ..... A44C 7/00
(52) U.S. Cl. ..... 63/12; 24/105; 411/180
(58) Field of Search ..... 63/12, 29.1; 24/105; 411/180; 433/173, 174, 191, 192, 193, 194, 195, 201.1, 206, 209, 211; 523/116; 606/184, 185, 188

(56) References Cited

U.S. PATENT DOCUMENTS

| | | | | |
|---|---|---|---|---|
| 320,991 | * | 6/1885 | Westcott | 24/705 |
| 1,793,712 | * | 2/1931 | Morehouse | 24/105 |
| 2,174,521 | * | 10/1939 | Lancaster | 24/105 |
| 3,945,089 | * | 3/1976 | Gagnon | 24/705 |
| 4,267,615 | * | 5/1981 | Nealy | 441/75 |
| 4,577,402 | * | 3/1986 | Swanstrom | 29/840 |
| 4,600,391 | * | 7/1986 | Jacob | 433/220 |
| 4,758,160 | * | 7/1988 | Ismail | 433/173 |
| 4,781,036 | * | 11/1988 | Erickson | 63/12 |
| 5,010,625 | * | 4/1991 | Joyer | 24/90.1 |
| 5,426,828 | * | 6/1995 | Kusano | 24/105 |
| 5,606,780 | * | 3/1997 | Kusano | 24/105 |
| 5,660,060 | * | 8/1997 | Catanzaro | 63/12 |
| 5,890,902 | * | 4/1999 | Sapian | 433/173 |
| 5,906,490 | * | 5/1999 | Primus et al. | 433/203.1 |
| 5,946,943 | * | 9/1999 | Hanson | 63/12 |
| 5,967,783 | * | 10/1999 | Ura | 433/174 |
| 6,026,659 | * | 2/2000 | Kaping, Jr. | 63/12 |

* cited by examiner

*Primary Examiner*—Anthony Knight
*Assistant Examiner*—Andrea Chop
(74) *Attorney, Agent, or Firm*—Bernard L. Kleinke; Foley & Lardner

(57) ABSTRACT

A cap for body piercing jewelry has a retention member for resisting passage through a pierced passageway. The retention member is composed of a plastic material. An enlarged end of a shank is anchored into the retention member with a threaded stud extending therefrom. The process to make the cap includes positioning viscous plastic material in a mold to produce the desired retention member shape. The enlarged portion of the shank is inserted and embedded into the plastic material. The enlarged portion of the shank has a pointed tip which enables the enlarged end of the shank to be inserted into the plastic material without producing visible unsightly air bubbles. As the shank is inserted into plastic material, the plastic material flows into anchors on the enlarged portion of the shank to assist in securing and locking the shank to the retention member.

6 Claims, 1 Drawing Sheet

BODY JEWELRY CAP

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Technical Field

The field of the present invention relates to body jewelry and methods for making the same. More particularly, this invention relates to body jewelry which may be extended through a passageway that has been pierced in a body.

2. Background Art

For centuries, adorning the human body with jewelry has been an important aspect of celebration and self-expression. In one aspect of displaying body jewelry a piercing instrument is used to create a passageway in a body part. A post is extended through the passageway and caps positioned on the ends of the post, with the caps acting to retain the post within the passageway of the body part. For example, a person may pierce a passageway through one or both earlobes. An appropriately ornamented earring is selected with a post extending from the earring. The length of the post is selected to extend through the passageway sufficiently so that a backing clip is positionable over the post. The backing clip typically slides over the post and frictionally couples to the post, thereby retaining the post in the passageway and positioning the earring for display.

However, body jewelry may be positioned on other body parts. For example, eyebrows, lips, nose bridges, tongue, other body parts may be pierced and various ornamental body jewelry positioned in the pierced passageway.

It is common for the body jewelry to be retained in the passageway by a larger cap that is frictionally retained to the post. For example, U.S. Pat. No. D394,412 shows a body jewelry having a post that may extend through a passageway. An ornamental ball acts as a cap to retain the post in the passageway. The cap appears to be held in place by compression forces applied by the post. Thus, the cap is frictionally coupled to the post.

In the body piercing art it is considered particularly exotic to pierce a passageway in the tongue and display body jewelry extending through the passageway. A popular body jewelry for display on a pierced tongue includes a post with enlarged end caps. The post is sized to extend through the passageway with the caps attaching threadably to each end of the post. This post with two caps is conveniently identified as a "bar bell stud."

In one type of prior known bar bell stud device, caps having an enlarged plastic part are threadably attached to at least one end of the post. The plastic part may be composed of LUCITE material to provide a distinctive appearance for the portion of the device disposed conspicuously above the tongue. A threaded portion extends from the plastic part for threading to a post.

To manufacture these known caps, a portion of a threaded rod is embedded in the plastic cap with a portion of the thread rod extending therefrom. Thus, the wearer may threadably attach the cap to the post. The attachment is tenuous, however, and the cap can become dislodged inadvertantly from the post. In this regard, the threaded rod can back out of the internal threads formed in the plastic cap. Such an unreliable attachment subjects the wearer to an unreasonable risk of injury.

Body jewelry positioned on the tongue is subjected to the same environmental condition as the wearer's mouth. Therefore, the jewelry will be subjected to the searing hots of hot food such as coffee and soups and the freezing colds of frozen foods such as shakes and ice cream. Such temperature extremes cause thermal expansion and contraction of the body jewelry device, thereby loosening the threaded rod from the plastic part. Further, the cap is subjected to the rotational forces necessary to tighten or remove the cap from the post. Thereby, due to thermal expansion and external forces the threaded rod may become loosened from the plastic portion of the cap.

When the threaded rod loosens and the plastic part of the cap works free, the plastic part of the cap will be released into the wearer's mouth cavity where it may damage teeth or be swallowed or aspirated. Further, the post and the other cap still may slip from the passageway in the tongue and likewise cause dental or gastronomic problems. Additionally, once the post is removed from the passageway, the tongue immediately begins healing the passageway and within a short period will prevent any post from being inserted through the passageway. Later, if another body jewelry is to be inserted into the same passageway, the person may be subjected to the discomfort and risk of an additional tongue piercing session Further, known prior art plastic caps for body piercing jewelry have been made of LUCITE material or other plastics that may leach bio-toxins. Such bio-toxins are especially dangerous when the body jewelry device and plastic cap portion are placed in the mouth. Thereby, the bio-toxins are introduced immediately into the body of the wearer and may produce undesirable and even dangerous results. Thus, it would be highly advantageous to have a plastic cap for a body piercing jewelry that did not leach bio-toxins.

Further, there are some situations where the wearer of body piercing jewelry does not wish to emphasize the presence of the body piercing jewelry. For example, a person with a pierced tongue may desire to minimize the presence of a bar bell tongue stud while in business situations. Known prior caps for bar bell studs are conspicuous. Therefore, it would be highly advantageous to have a bar bell stud which could be worn in the mouth inconspicuously.

Further, known bar bell studs having plastic cap parts have a rather unprofessional and aesthetically displeasing appearance. As the plastic part of the cap is generally translucent, the threaded rod may be readily seen. Indeed, seeing the threads extend into the translucent plastic portion may actually appear to a wearer that the unit could become inadvertently disassembled.

The aesthetics of known plastic parts for caps is also negatively affected by trapped air bubbles during the manufacturing process. For example, as the threaded rod is inserted into the plastic material in the mold, air is trapped in the plastic material. After the plastic cures, the unsightly air bubbles are plainly visible due to the translucent nature of the plastic. Such air bubbles cause the plastic parts to have a displeasing, low quality appearance.

It would be highly desirable to have an aesthetically pleasing, air bubble free, appearance to the translucent plastic cap parts used for body piercing jewelry.

Therefore, there exists a need for a cap for use on body piercing jewelry where the threaded portion does not tend to become disassembled from the plastic part of the cap, allows for greater visual versatility, does not leach bio-toxins, and has a more aesthetically pleasing appearance. Such a cap and bar bell stud should be relatively inexpensive to manufacture.

SUMMARY OF THE INVENTION

It is therefore a principal object of the present invention to provide a body piercing jewelry having a cap where the threaded portion of the cap is securely and fixedly attached to the plastic portion of the cap.

It is a further object of the present invention to provide a body piercing jewelry which may be relatively safely used in the mouth, and which may be relatively inexpensive to manufacture.

It is a further object of the present invention to provide a body piercing jewelry with a cap that has an aesthetically pleasing appearance and provides a wide range of visual options.

To overcome the disadvantages in the prior art and meet the objectives of this invention, a body jewelry device and method for making the same is herein disclosed and claimed.

A cap for body piercing jewelry has a retention member for resisting passage through a pierced passageway The retention member is composed of a plastic material. An enlarged end of a shank is anchored into the retention member with a threaded stud extending therefrom. The process to make the cap includes positioning viscous plastic material in a mold to produce the desired retention member shape. The enlarged portion of the shank is inserted and embedded into the plastic material. The enlarged portion of the shank has a pointed tip which enables the enlarged end of the shank to be inserted into the plastic material without producing visible unsightly air bubbles. As the shank is inserted into plastic material, the plastic material flows into anchors on the enlarged portion of the shank to assist in securing and locking the shank to the retention member.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
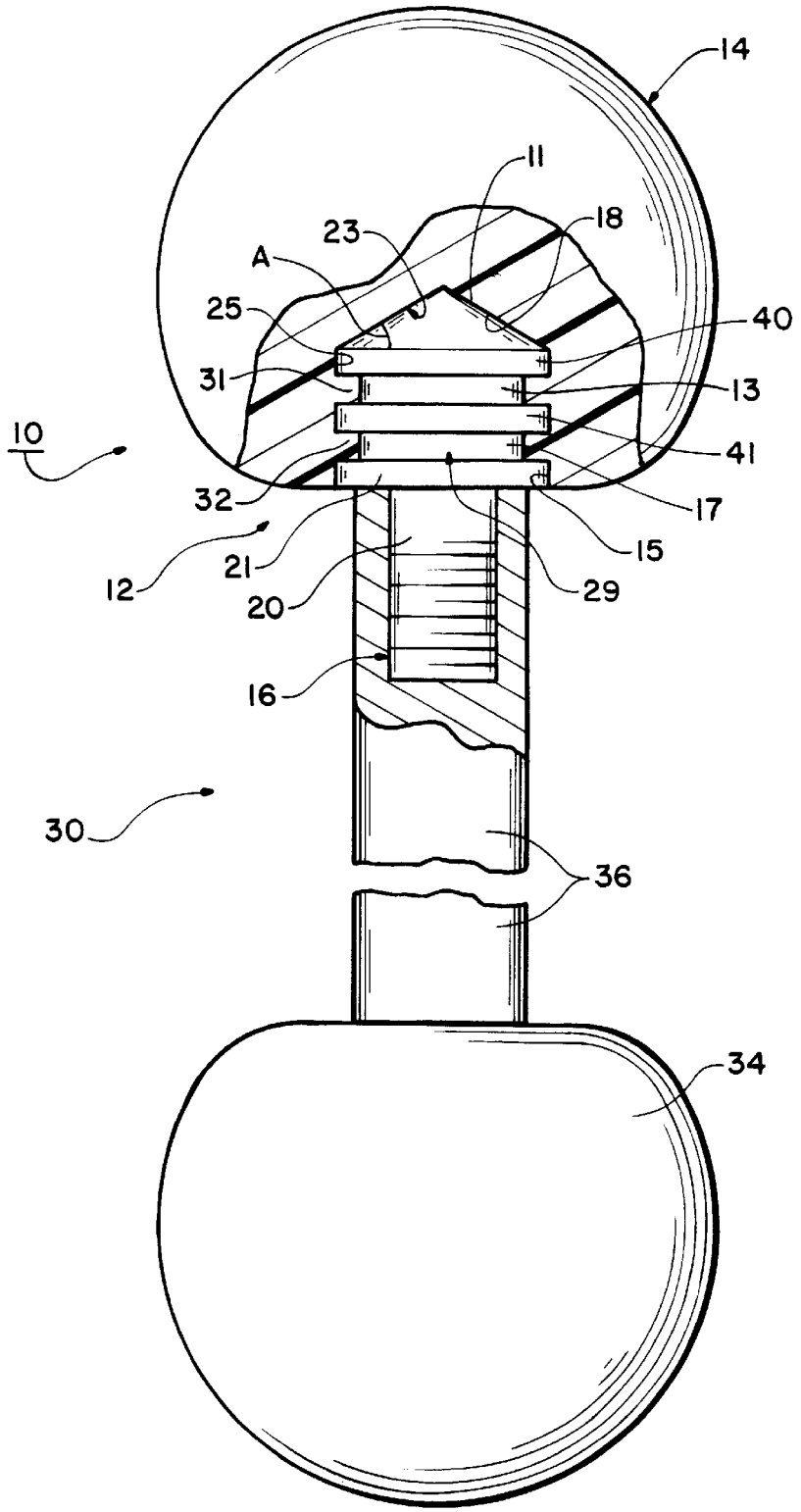
FIG. 1 is an elevational partial cross-section view of a bar bell stud having a cap, which are made in accordance with the present invention.

Referring to FIG. 1, a body jewelry bar bells stud 30 having a pair of end caps 10 and 34 are made in accordance with the present invention, are shown. The caps 14 and 34 are similar to one another. However, a more conventional cap (not shown) may be used in place of the cap 34.

The cap 10 generally comprises a bulbous generally spherical retention member or ball 14 and a shank 12. The shank 12 is composed of metal material and has a head portion 18 which is received within an opening generally indicated at 23 in the retention member 14. The shank 12 is locked to the retention member 14 in accordance with the present invention. Further the head portion 18 has a pointed conical top 11 which permits the formation of the retention member 14 without visible air bubbles during the manufacturing process.

The caps 10 and 34 are connected to the opposite ends of a post 36 of the stud 30. In use, the post 36 extends through a pierced body passageway (not shown) in a wearer's tongue or other body part. The cap 10 threadably attaches to one end of the post 36. The other cap 34 threadably couples to the other end of the post 36. The post 36 is composed of metal and is cylindircal rodlike in shape and sized with a cross-section sufficient to allow its insertion through the pierced passageway in the tongue. Further, the post 12 has a length sufficient to allow the caps 10 and 34 to be threaded thereupon with the post positioned in the passageway. The caps 10 and 34 are sized to resist passing through the passageway piercing the tongue. Thereby, when the post 36 is inserted through the passageway in the tongue and the caps 10 and 34 attached to the post, the bar bell stud 30 is securely held on the tongue.

Referring again to FIG. 1, the retention member 14 is composed of a plastic material and sized to resist passing through a passageway pierced in a wearer's tongue. The retention member 14 may take several shapes but preferably is in the shape of a ball. Although retention number 14 may be made from several types of plastics, including thermoplastics, the retention member 14 is preferably composed of an acrylic. Most preferably, the retention member is composed of a dental quality acrylic which is already approved for oral use. With the use of acrylic and most preferably a dental quality acrylic, bio-toxins are not leached into the wearer's body, even when the body piercing jewelry is worn in the mouth.

The shank 12 includes an enlarged internal portion generally indicated at 29 and an external stub 16. The external stub 16 has a threaded portion 20 for threadably coupling to the internal mating threads (not shown) in the end of thee post 36.

The enlarged internal portion 29 of the shank 12 is constructed to mate in a complementary fashion with the internal opening 23 of the retention member. The enlarged internal portion 29 is generally cylindrically shaped and has two annular grooves 13 and 17, which receive a pair of respective internal annular shoulders 31 and 32 of the retention member 14. The grooves serve as undercuts and cooperate with the shoulders to lock the enlarged portion 29 within the retention member 14. A pair of flats 40 and 41 on the interportion 29 on opposite sides of the groove 13 serve to help prevent relative rotation of the shank and the retention member.

The pointed top 11 fits within a complementary shaped conical opening 18 of the internal opening 23. Those skilled in the art will recognize that a pointed top may be provided in various forms including bullet shaped, rounded, or oval shaped.

The conical shape of the pointed top 11 is generally defined by the angle A. Preferably, angle A is in a range from about 10 degrees to about 55 degrees. More preferably angle A is in the range of about 20 degrees to about 45 degrees. Most preferably angle A is about 20 degrees. The pointed top 11 permits the formation of the retention member 14 without the introduction or trapping of visible bubbles in the finished part following the setting of the plastic material.

In such a matter, the integral internal annular shoulders 31 and 32 are permanently and fixedly retained in the grooves 17 and 13 and are firmly bonded to the enlarged portion 29. Thus, the shank 12 may not be backed out of the retention member 14 without causing severe permanent damage to the cap 10. As a practical matter, the shank 12 is permanently locked fixedly in place and anchored to the retention member 14.

In a similar manner, the enlarged internal portion 29 provides substantial surface area for contacting the internal surface of the mating opening 23 of the retention member 14. Further, the grooves 17 and 13 provide additional surface area for contacting the plastic material of the retention member 14. In such a manner, the plastic material of retention member 14 contacts a substantial surface area of the enlarged internal portion 29. Thereby, it is unlikely, if not impossible, that the shank 12 and the retention member 14 will rotate relative to one another.

Thus, the shank 12 cannot be removed from retention member 14, thereby eliminating or at least greatly reducing the risk that the retention member and shank will separate and cause the wearer to bite or swallow parts of the body jewelry.

The configuration of the pointed top 11 has been selected to assist in the formation and assembly of the cap 10. In forming the cap 10, a viscous plastic material is placed in a female mold part. A male mold part gently inserts the shank 12 into the center of the plastic material until the enlarged internal portion 29 is fully received into the plastic material. As the pointed top 11 pushes into the viscous plastic material, the viscous plastic material is gently pushed along the conical shape of the pointed top 11. Such gentle motion avoids trapping or creating unwanted air bubbles in the retention member 14. After fully inserted, the plastic material is permitted to cure and the molds separated. Thereby, by using a pointed top 11 as disclosed herein, the shank 12 may be inserted into the retention member 14 without creating unsightly air bubbles.

Further, as the shank 12 is inserted into the plastic material, the viscous plastic material flows into the grooves 13 and 17, thereby filling the grooves 17 and 13. The integral internal annular shoulders 31 and 32 are thereby formed within grooves 17 and 13. As discussed above, these shoulders not only lock the shank 12 into the retention member 14, but the contact with the increased surface area provided by the grooves, assists in keeping the shank 12 from rotating and firmly bonds and attaches the plastic material to the metal shank 12.

In making the cap 10, the plastic material is preferably acrylic. In forming an acrylic retention member, a resin powder and a liquid catalyst are combined to form a viscous plastic material. The viscous material is then positioned in a mold part as discussed above. In a preferred method, the liquid catalyst and the mold are pre-chilled to a temperature in the range of about 30 degrees to about 50 degrees Fahrenheit. Most preferably, the liquid catalyst and the mold are pre-chilled to a temperature in the range of about 32 degrees to about 45 degrees Fahrenheit.

Pre-chilling the liquid catalyst and the mold appears to helps inhibit the formation of air bubbles and improve the visual appearance of the finished cap. After the plastic material is positioned in the mold, the process continues as discussed above.

The cap 34 is also threadably attached to the post 36. The cap 34 may be a cap as taught in U.S. patent application Ser. No. 09/177,308, filed Oct. 22, 1998, which is incorporated herein by reference, and which is now U.S. Pat. No. 6,026,659. Those skilled in the art will recognize that there are several alternatives for cap 34.

The retention member is composed of a plastic material, preferably an acrylic. As such, it may be presented in a variety of aesthetically pleasing ways. For example, the acrylic may be clear or an opaque flesh tone to minimize the cap's conspicuousness. In such a manner, a wearer wanting to de-emphasize the presence of a bar bell stud could use this clear or flesh colored cap to minimize the visual attention given the bar bell stud. Further, the retention member may be made in a variety of colors including bright colors or even fluorescent colors. In such a manner, the presence of the bar bell stud will be emphasized. Additionally, the acrylic may have a pleasant translucent appearance. In such a manner, the enlarged portion of the shank may be visible. However, the enlarged portion of the shank is a finely manufactured metal part which imparts an appearance of high quality. Thereby, the cap has a high quality aesthetically pleasing appearance even when translucent acrylic is used.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A bar bell stud body jewelry, comprising:

a post for insertion in a pierced passageway; and a pair of end caps, at least one of the caps being a coupling cap capable of being coupled to the post for retaining the post in the passageway, the coupling cap further comprising:

a substantially bubble-free retention member sized to resist passing through a pierced body passageway of a wearer, and composed of plastic material;

an elongated rigid shank anchored in the retention member, the shank having a head portion embedded in the retention member and a stub portion extending outwardly from the retention member;

anchoring means on the head portion having means defining an undercut for locking securely and for capturing the shank to the retention member in a manner assisting retention therein;

said means defining an undercut for receiving a portion of said plastic material to prevent said shank from withdrawing from the retention member;

wherein the head portion has a pointed tip facilitating formation of the coupling cap to help avoid formation of bubbles in the retention member during formation of the coupling cap; and wherein the coupling cap threadably couples to the post.

2. The bar bell stud according the claim 1, wherein the post is manufactured from a metal.

3. The bar bell stud according the claim 1, wherein a second cap of said pair of end caps is a cap composed of metal.

4. The bar bell stud according the claim 1, wherein the plastic material of the coupling cap is acrylic.

5. The bar bell stud according the claim 1, wherein the plastic material of the coupling cap is a dental acrylic.

6. A bar bell stud body jewelry, comprising:

a post for insertion in a pierced passageway; and a pair of end caps, at least one of the caps being a coupling cap capable of being coupled to the post for retaining the post in the passageway, the coupling cap further comprising:

a substantially bubble-free retention member sized to resist passing through a pierced body passageway of a wearer, and composed of plastic material;

an elongated rigid shank anchored in the retention member, the shank having a head portion embedded in the retention member and a stub portion extending outwardly from the retention member;

anchoring means on the head portion having means defining an undercut for locking securely and for capturing the shank to the retention member in a manner assisting retention therein;

said means defining an undercut for receiving a portion of said plastic material to prevent said shank from withdrawing from the retention member;

wherein the head portion has a pointed tip facilitating formation of the coupling cap to help avoid formation of bubbles in the retention member during formation of the coupling cap; and wherein a second cap of said pair of end caps is identical to the coupling cap.

* * * * *